US007474053B2

(12) United States Patent
Lin

(10) Patent No.: US 7,474,053 B2
(45) Date of Patent: Jan. 6, 2009

(54) PLASMA DISPLAY PANEL WITHOUT TRANSPARENT ELECTRODES

(75) Inventor: Ching-Hui Lin, Tao-Yuan Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 478 days.

(21) Appl. No.: 11/306,258

(22) Filed: Dec. 21, 2005

(65) Prior Publication Data

US 2007/0138958 A1 Jun. 21, 2007

(51) Int. Cl.
*H01J 17/49* (2006.01)

(52) U.S. Cl. ..... 313/582; 313/584

(58) Field of Classification Search ..... 313/582, 313/583, 584

See application file for complete search history.

(56) References Cited

U.S. PATENT DOCUMENTS 6,815,890 B2 * 11/2004 Tsai et al. ..... 313/584
7,102,286 B2 * 9/2006 Shibata et al. ..... 313/586
7,259,516 B2 * 8/2007 Wan et al. ..... 313/582

* cited by examiner

*Primary Examiner*—Vip Patel
(74) *Attorney, Agent, or Firm*—Winston Hsu

(57) ABSTRACT

A honeycomb type plasma display panel has a honeycombed barrier rib structure which defines a plurality of cells, and a plurality of scan electrodes and a plurality of maintain electrodes arranged alternately in a first direction. Each scan electrode has a first bus electrode and a plurality of first protrusions, and each maintain electrode has a second bus electrode and a plurality of second protrusions. The first bus electrodes, the first protrusions, the second bus electrodes, and the second protrusions are metal electrodes.

5 Claims, 7 Drawing Sheets

PLASMA DISPLAY PANEL WITHOUT TRANSPARENT ELECTRODES

BACKGROUND OF THE INVENTION

1. Field of the Invention

The present invention pertains to a honeycomb type plasma display panel, and more particularly, to a honeycomb type plasma display panel without transparent electrodes.

2. Description of the Prior Art

In recent years, plasma display panel (hereinafter referred to as PDP) has been replaced cathode ray tube (CRT) for its features of large display size, wide view angle, high resolution, etc. Take a surface discharge type PDP for example, scan electrodes and maintain electrodes are arranged in parallel on a front substrate, and address electrodes are arranged in parallel and orthogonal to the scan electrodes and maintain electrodes on a rear substrate so as to form a plurality of cell. Normally, The surface discharge type PDP can be classified into two types: stripe type and grid (matrix) type. The stripe type PDP has a barrier rib structure includes a plurality of linear partitions arranged in a column direction, in which the cells positioned in a same column are ventilative. On the other hand, the barrier rib structure of a grid type PDP has a grid shape, and each cell is separated by partitions from adjacent cells.

Please refer to FIG. 1 and FIG. 2. FIG. 1 schematically illustrates an oblique view of a conventional grid type PDP, and FIG. 2 schematically illustrates a cross-sectional view of a conventional grid type PDP. As shown in FIG. 1 and FIG. 2, the conventional PDP 10 includes a front substrate 20 and a rear substrate 30 made of glass. The front substrate 20 includes a plurality of scan electrodes 21 and a plurality of maintain electrodes 22 disposed on the bottom surface of the front substrate 20. The scan electrodes 21 and the maintain electrodes 22 are arranged in parallel at an equal pitch. Each of the scan electrodes 21 and the maintain electrodes 22 are overlapped with a dielectric layer 23 and a protection layer 24 made of magnesia (MgO). Each scan electrode 21 includes a transparent electrode 211 made of transparent materials such as indium tin oxide (ITO) and a bus electrode 212 made of metal such as silver (Ag). Each maintain electrode 22 includes a transparent electrode 221 made of transparent materials such as ITO and a bus electrode 222 made of metal such as Ag. The scan electrodes 21 and the maintain electrodes 22 are electrically connected to driver circuits (not shown).

The rear substrate 30 includes a plurality of address electrodes 31 disposed on the upper surface of the rear substrate 30. The address electrodes 31 are arranged in parallel and orthogonal to the scan electrodes 21 and the maintain electrodes 22. The address electrodes 31 are covered with a dielectric layer 32. On the dielectric layer 32, a barrier rib structure 33 having a grid pattern is arranged. The barrier rib structure 33 defines a plurality of cells including red cells 34R, green cells 34G, and blue cells 34B). In addition, fluorescent materials 35R, 35G, and 35B are respectively coated on the dielectric layer 32 and the inner walls of the barrier rib structure 33 in the red cells 34R, the green cells 34G, and the blue cells 34B, so as to generate color images.

The transparent electrodes 211 and 221 are transparent, and thus light emitted from the cells is not shielded. However, the conductivity of the transparent electrodes 211 and 221 is insufficient. In such a condition, the bus electrodes 212 and 222 made of metal are adopted for improving the conductivity.

Recently, a new type of PDP (referred to as honeycomb type PDP) has been presented. The honeycomb type PDP is characterized by having a honeycombed barrier rib structure. Please refer to FIG. 3. FIG. 3 illustrates a honeycombed barrier rib structure of a honeycomb type PDP. As shown in FIG. 4, the honeycombed barrier rib structure 40 has a plurality of hexagonal cells including red cells 42R, green cells 42G, and blue cells 42B. To our knowledge, the honeycomb tiling is more efficient than a grid tiling. Thus, the aperture ratio of a honeycomb type PDP is significantly improved comparing to a grid type PDP. Since the luminance is improved, the electrical property e.g. addressing speed becomes another point to be improved.

SUMMARY OF THE INVENTION

It is therefore one object of the claimed invention to provide a honeycomb type plasma display panel to overcome the aforementioned problems.

In one aspect of the present invention, a honeycomb type plasma display panel is provided. The honeycomb type plasma display panel includes a honeycombed barrier rib structure which defines a plurality of cells, and a plurality of scan electrodes and a plurality of maintain electrodes arranged alternately in a first direction. Each scan electrode has a first bus electrode and a plurality of first protrusions, and each maintain electrode has a second bus electrode and a plurality of second protrusions. The first bus electrodes, the first protrusions, the second bus electrodes, and the second protrusions are metal electrodes.

It can be seen that the first bus electrodes, the first protrusions, the second bus electrodes, and the second protrusions are made of metal that has a low resistivity, and thus the electric performance of the honeycomb type plasma display panel is improved. In addition, the scan electrodes and the maintain electrodes exclude transparent electrodes, and therefore the manufacture process is simplified. Consequently, the manufacture cost is reduced.

These and other objectives of the present invention will no doubt become obvious to those of ordinary skill in the art after reading the following detailed description of the preferred embodiment that is illustrated in the various figures and drawings.

DETAILED DESCRIPTION

The spirit of the present invention lies in forming scan electrodes and maintain electrodes without transparent conductive materials, so as to improve the electrical performance of a honeycomb type plasma display panel.

Figure 1:
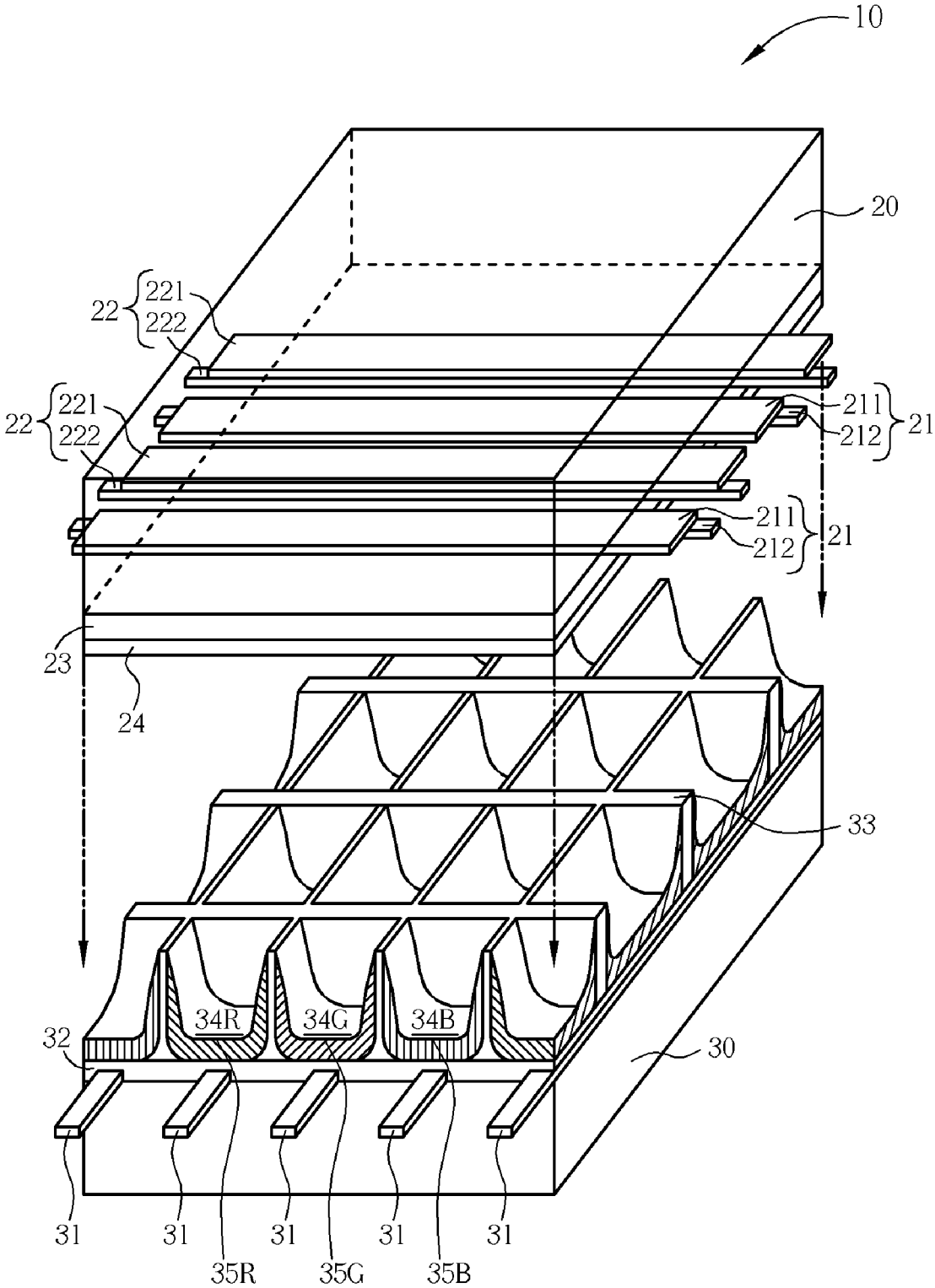
Fig. 1 Prior art
FIG. 1 schematically illustrates an oblique view of a conventional grid type PDP.
Figure 2:
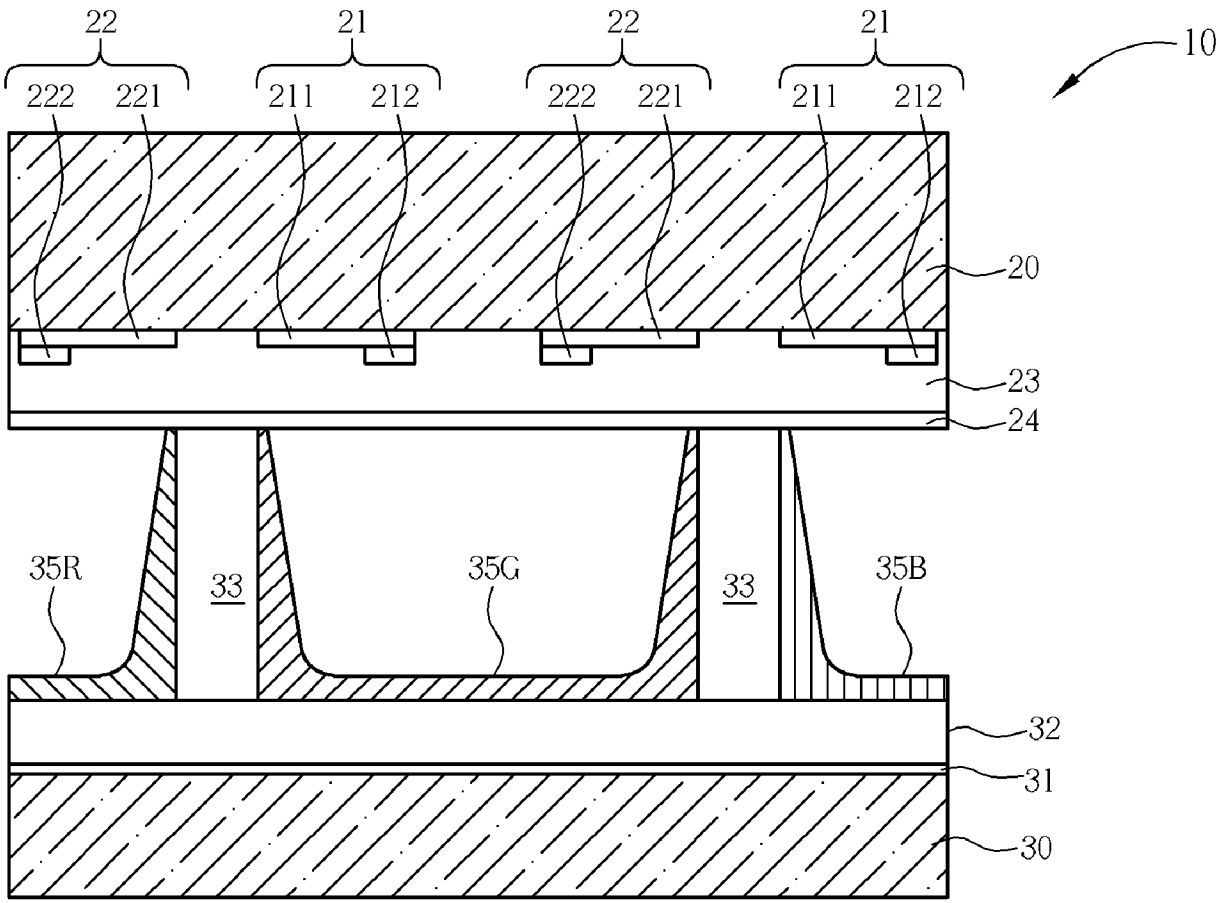
Fig. 2 Prior art
FIG. 2 schematically illustrates a cross-sectional view of a conventional grid type PDP.
Figure 3:
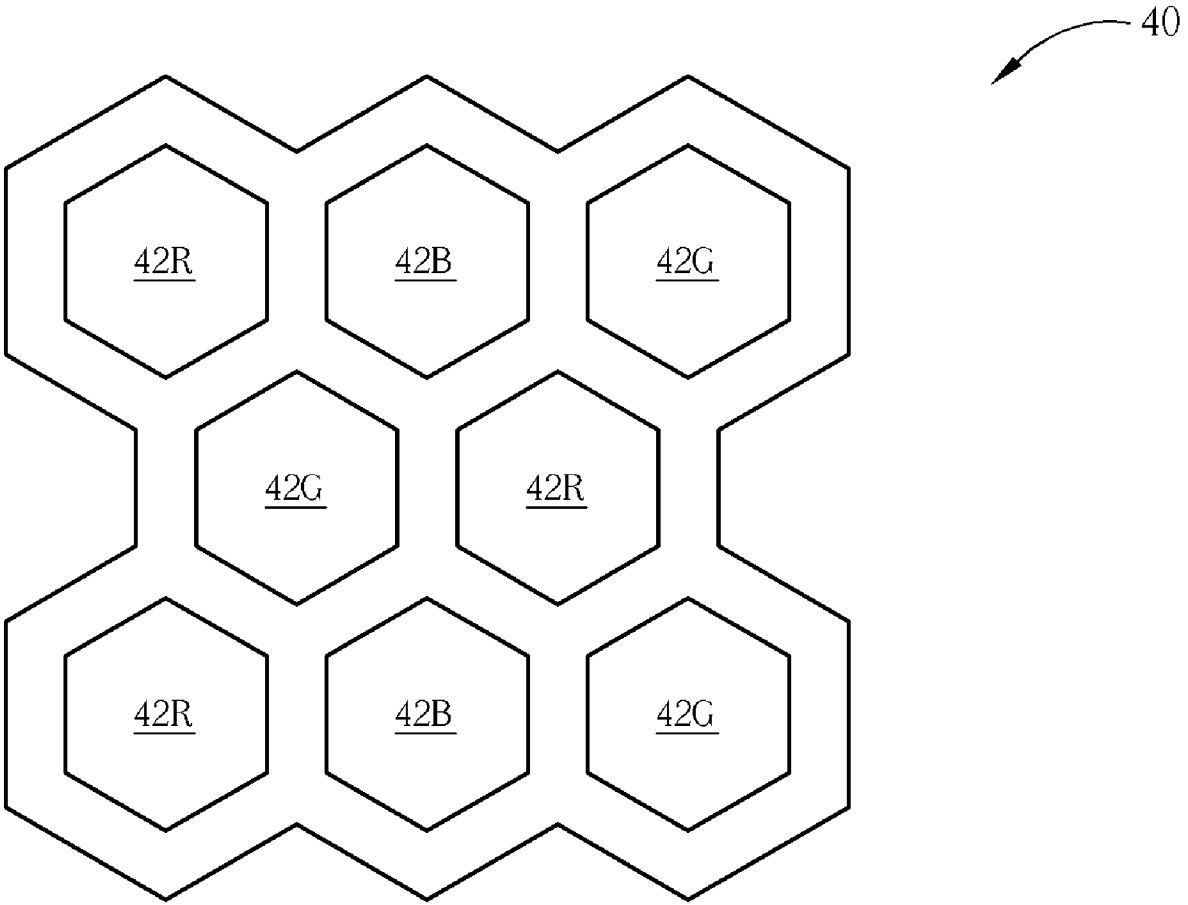
Fig. 3 Prior art
FIG. 3 illustrates a honeycombed barrier rib structure of a honeycomb type PDP.
Figure 4:
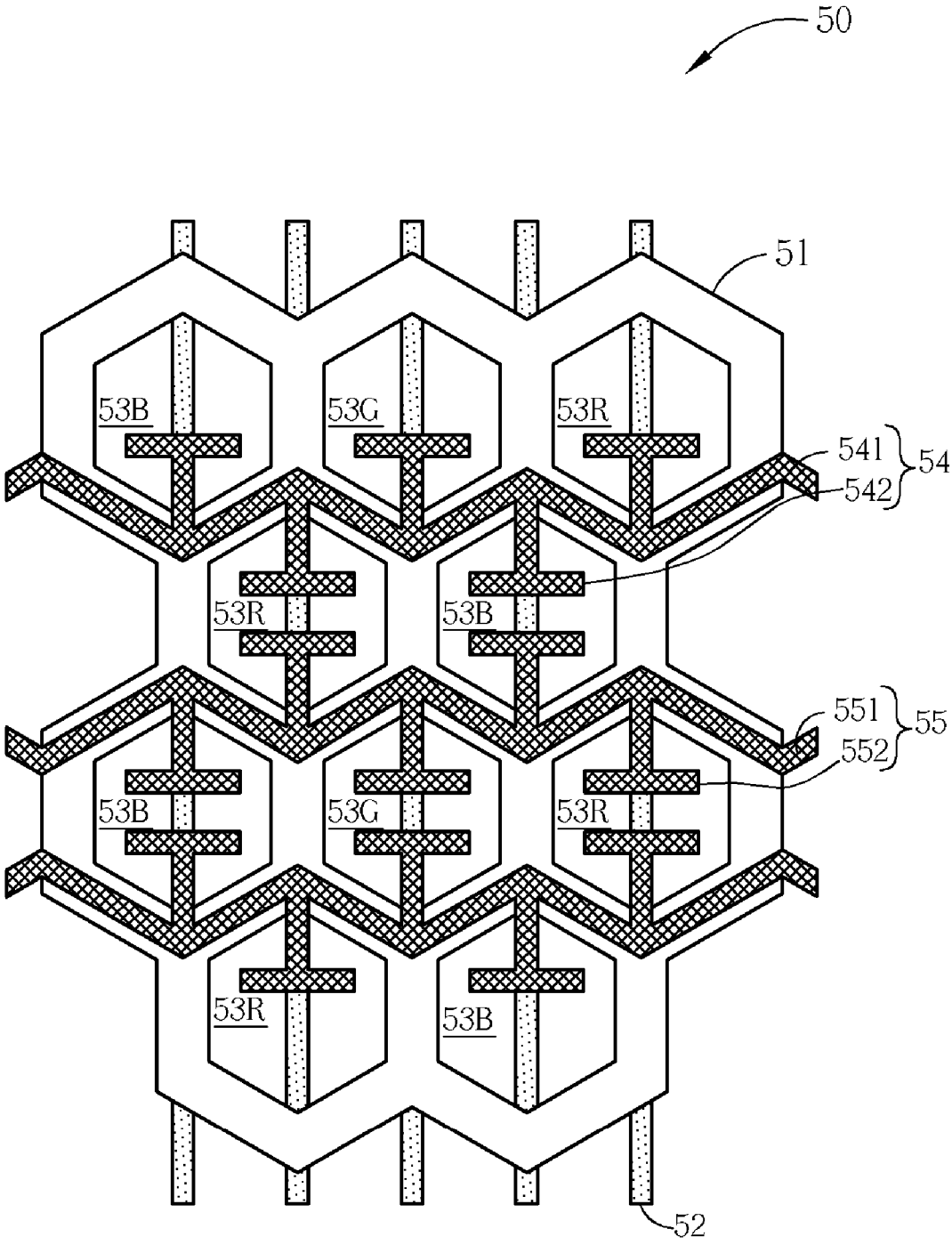
FIG. 4 schematically illustrates a honeycomb type plasma display panel according to a first preferred embodiment of the present invention.

Please refer to FIG. 4. FIG. 4 schematically illustrates a honeycomb type plasma display panel according to a first preferred embodiment of the present invention. As shown in FIG. 4, the plasma display panel (hereinafter referred to as PDP) 50 includes a honeycombed barrier rib structure 51 disposed on a rear substrate (not shown), and a plurality of address electrodes 52 arranged in parallel in a second direction. The honeycomb barrier rib structure 51 defines a plurality of cells, and different fluorescent materials are coated into the cells to form red cells 53R, green cells 53G, and blue cells 53B. Each cell is hexagonal and arranged like a honeycomb. In addition, each cell is separated by the honeycomb barrier rib structure 51 from adjacent cells. This separated structure reduces interference between adjacent cells while discharging.

The PDP 50 includes a plurality of scan electrodes 54 and a plurality of maintain electrodes 55 arranged in parallel and alternately in a first direction approximately orthogonal to the second direction. Each scan electrode 54 has a first bus electrode 541 and a plurality of first protrusions 542, and each maintain electrode 55 has a second bus electrode 551 and a plurality of second protrusions 552. In this embodiment, each first bus electrode 541 of the scan electrodes 54 and each second bus electrode 551 of the maintain electrodes 55 has a zigzag shape, and overlaps the honeycombed barrier rib structure 51. In such a case, the first bus electrodes 541 and the second bus electrodes 551 do not shield the light generated in the cells 53. The first bus electrodes 541, the first protrusions 542, the second bus electrodes 551, and the second protrusions 552 are all metal electrodes, e.g. silver, nickel, aluminum, etc., which has low resistivity.

In this embodiment, each first protrusion 542 and each second protrusion 552 is T-shaped. The first protrusions 542 and the second protrusions 552 aim at improvement of discharge efficiency and addressing speed at the cost of slight reduction of aperture ratio. As described, the honeycomb type PDP 50 is characterized by high luminance, and the electrical property is indeed the issue to be improved. Thus, the first protrusions 542 and the second protrusions 552 slightly reduce the luminance, but greatly improve the addressing speed.

Figure 5:
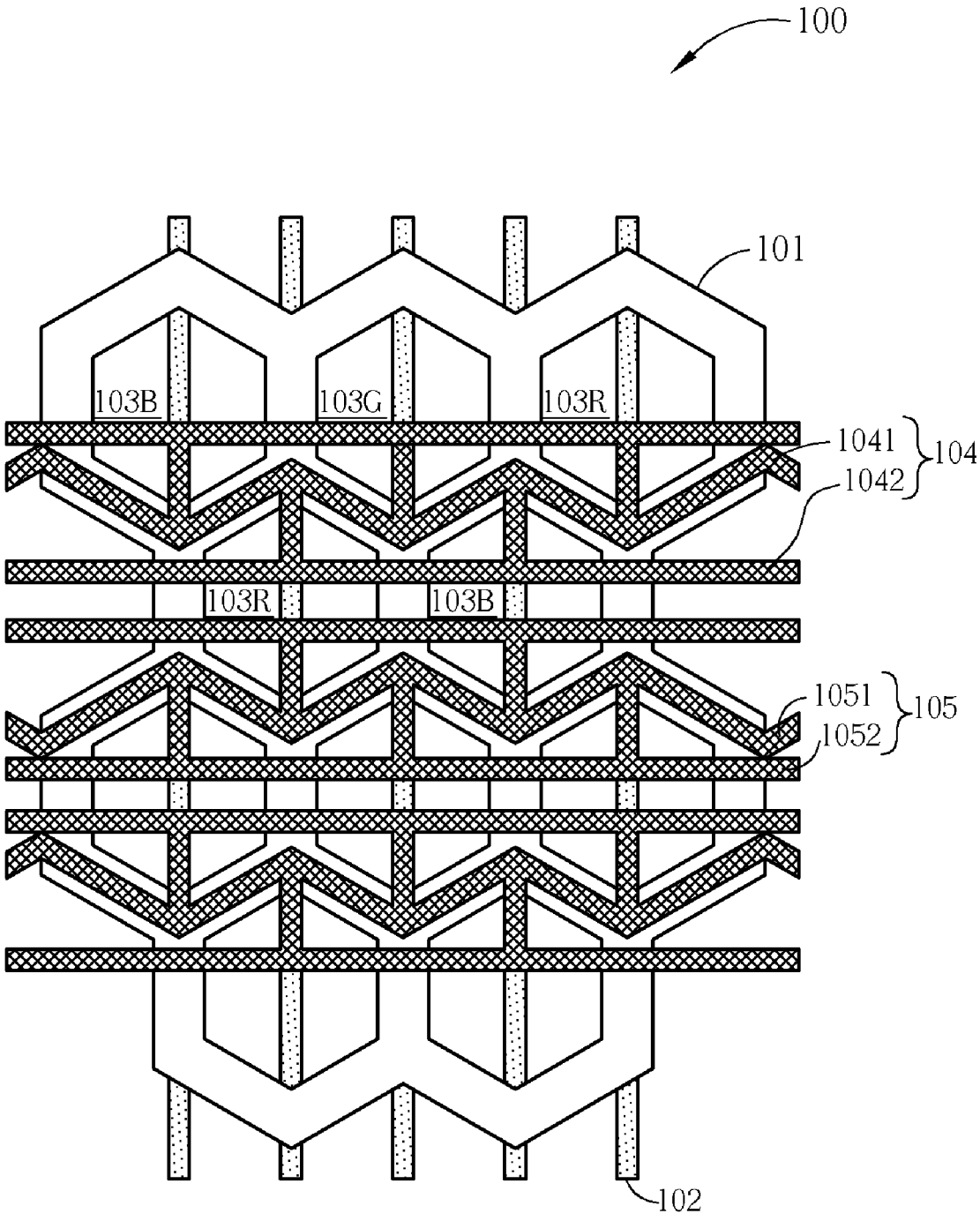
FIG. 5 schematically illustrates a honeycomb type PDP according to a second preferred embodiment of the present invention.

Please refer to FIG. 5. FIG. 5 schematically illustrates a honeycomb type PDP according to a second preferred embodiment of the present invention. As shown in FIG. 5, each first bus electrode 1041 and each second bus electrode 1051 has a stripe shape. Also, each first protrusion 1042 and each second protrusion 1052 has a rectangular shape.

Figure 6:
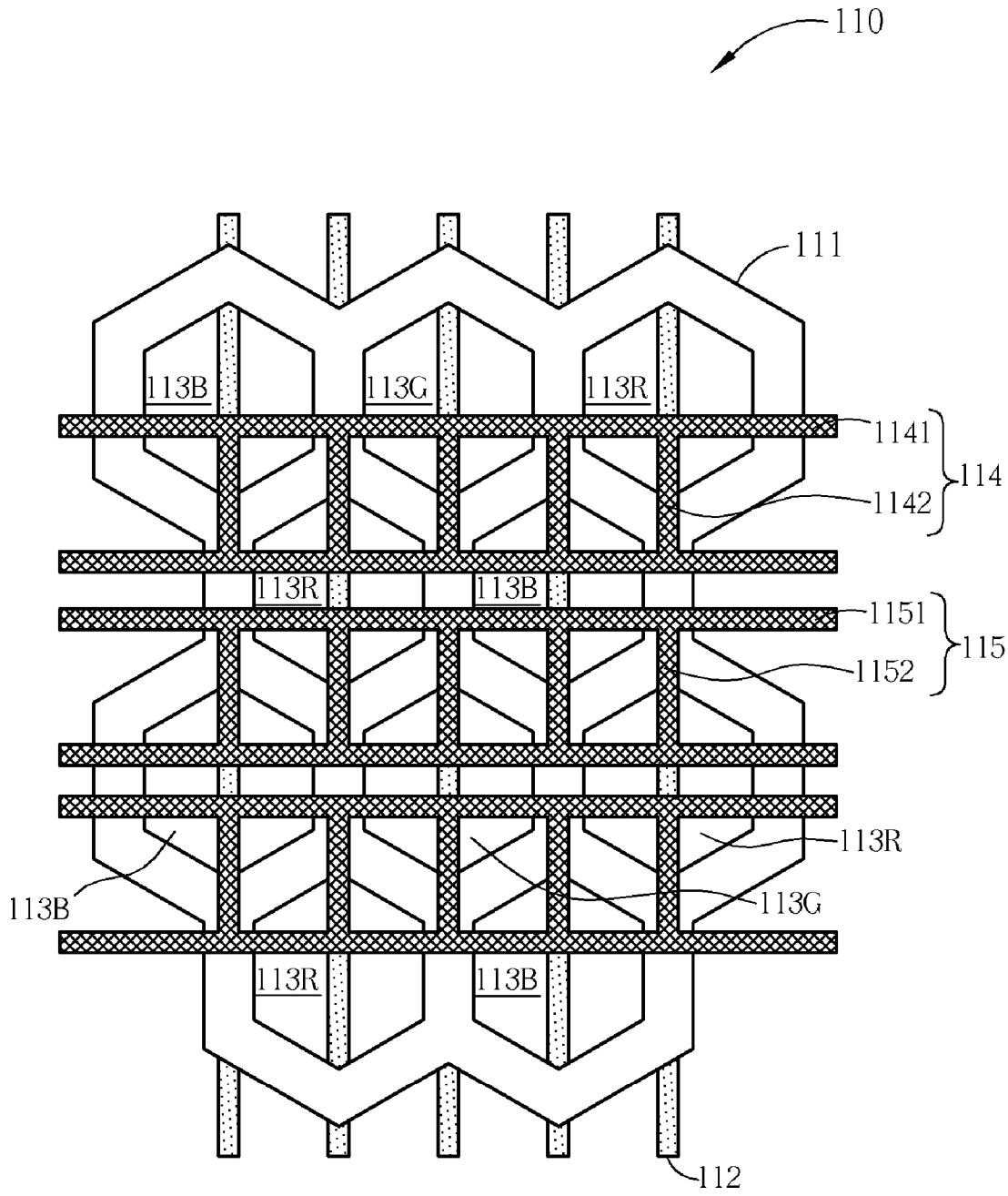
FIG. 6 schematically illustrates a honeycomb type PDP according to a third preferred embodiment of the present invention.

Please refer to FIG. 6. FIG. 6 schematically illustrates a honeycomb type PDP according to a third preferred embodiment of the present invention. As shown in FIG. 6, each first bus electrode 1141 has a pattern of two stripes with a plurality of first protrusions 1142 arranged therebetween. Similarly, each second bus electrode 1151 has a pattern of two stripes with a plurality of second protrusions 1152 arranged therebetween.

Figure 7:
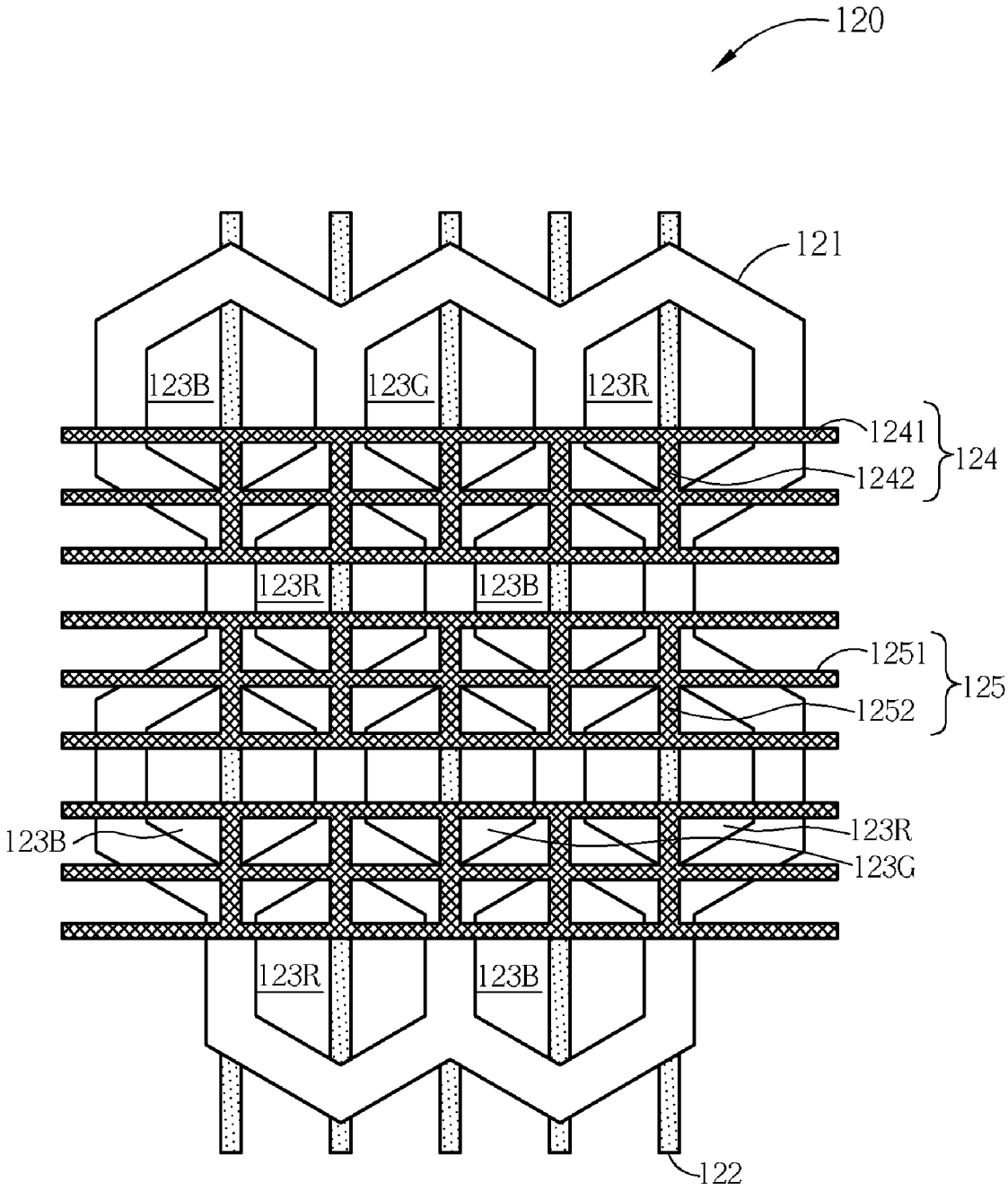
FIG. 7 schematically illustrates a honeycomb type PDP according to a fourth preferred embodiment of the present invention.

Please refer to FIG. 7. FIG. 7 schematically illustrates a honeycomb type PDP according to a fourth preferred embodiment of the present invention. As shown in FIG. 7, each first bus electrode 1241 has a pattern of three stripes with a plurality of first protrusions 1242 arranged therebetween. Similarly, each second bus electrode 1251 has a pattern of three stripes with a plurality of second protrusions 1252 arranged therebetween.

In conclusion, since a honeycomb type PDP has high luminance, the first bus electrodes, the first protrusions, the second bus electrodes, and the second protrusions made of metal effectively improve the electrical performance of the honeycomb type PDP at the cost of slightly reduction of luminance. In addition, the scan electrodes and the maintain electrodes exclude transparent electrodes, and therefore the manufacture process is simplified. Consequently, the manufacture cost is reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A honeycomb type plasma display panel comprising:

a honeycombed barrier rib structure which defines a plurality of cells; and a plurality of scan electrodes excluding transparent electrodes, each scan electrode having a first bus electrode and a plurality of first protrusions; and a plurality of maintain electrodes excluding transparent electrodes, each maintain electrode having a second bus electrode and a plurality of second protrusions;

wherein the first bus electrodes, the first protrusions, the second bus electrodes, and the second protrusions are metal electrodes.

2. The plasma display panel of claim 1, wherein each first bus electrode and each second bus electrode has a stripe shape.

3. The plasma display panel of claim 1, wherein each first bus electrode and each second bus electrode has a zigzag shape.

4. The plasma display panel of claim 3, wherein the first bus electrodes and the second bus electrodes overlap the honeycombed barrier rib structure.

5. The plasma display panel of claim 1, wherein each first protrusion and each second protrusion is T-shaped.

* * * * *